United States Patent [19]

Slater

[11] 4,082,595

[45] Apr. 4, 1978

[54] PRESSURE SENSITIVE LABEL APPLICATOR

[76] Inventor: John W. Slater, 4679 N. Ironwood La., Milwaukee, Wis. 53209

[21] Appl. No.: 681,865

[22] Filed: Apr. 29, 1976

[51] Int. Cl.[2] ..... B65H 25/00

[52] U.S. Cl. ..... 156/351; 156/361; 156/364; 156/542; 271/10; 271/110; 271/265

[58] Field of Search ..... 156/350, 351, 361, 364, 156/569-570, 558-559, 540-542; 271/10, 12, 13, 4, 110, 111, 271, 275, 277, 34, 38, 258, 265

[56] References Cited

U.S. PATENT DOCUMENTS

| | | | |
|---|---|---|---|
| 2,915,309 | 12/1959 | McGihon | 271/10 |
| 3,625,803 | 12/1969 | Masulis | 156/364 X |
| 3,721,601 | 3/1973 | Dituch et al. | 156/361 X |
| 3,816,210 | 6/1974 | Aoko et al. | 156/361 X |
| 3,924,848 | 12/1975 | Murakami | 271/10 |
| 3,947,016 | 3/1976 | Horung et al. | 271/265 X |

*Primary Examiner*—David A. Simmons

*Attorney, Agent, or Firm*—Wheeler, Morsell, House & Fuller

[57] ABSTRACT

A compact labeling machine for applying pressure sensitive labels to mailing pieces such as magazines and envelopes is provided with a variable speed drive and is adapted to accommodate various size labels and mailing pieces at a high output rate. Positive control of an article feed roller associated with a supply hopper is afforded by a microswitch which is actuated by flights or lugs on conveyor chains which carry the article to be labeled from the feed roller to the labeling station. The article feed cycle is stoppd by a microswitch which has a feeler engaged by articles carried by the conveyor flights. The label feed mechanism includes a brake and clutch connected to a draw roller which draws the label web over a peel plate for positive control of the label feed. The label feed cycle is commenced by engagement of the article to be labeled with the feeler of a switch in the conveying path. A light sensor associated with the label carrying web monitors the presence of a label and the gap between labels and de-energizes the label drive feed clutch when a gap between labels is sensed. The label web stops when a label is partially peeled from the web. The article sensing switches are adjustably mounted for longitudinal movement so that adjustment of switch position is easily accomplished for appropriate timing of the article and label feed cycles for articles of different sizes.

4 Claims, 4 Drawing Figures

PRESSURE SENSITIVE LABEL APPLICATOR

SUMMARY OF INVENTION

The invention provides labeling apparatus for flat articles such as magazines, catalogs, envelopes, etc., which are hereinafter referred to as "forms." The labeling machine is provided with a variable speed drive to vary the output of forms per hour from rates of approximately 1,000 to 10,000 forms per hour. The infeed conveyor, the outfeed conveyor, the form feed roller and the label feed mechanism are all driven from a common output shaft driven by a single motor with a manually variable diameter pulley. Varying the diameter of the pulley simultaneously changes the speeds of all of these components.

The form feed roller and feed cycle are positively controlled by a start switch and stop switch associated with the infeed conveyor. The start switch is actuated by flights or lugs on one of three conveyor chains which lugs are laterally aligned on three spaced conveyor chains to engage the trailing edge of the form and convey the form to the labeling station and outfeed conveyor. The form feed is interrupted by the stop switch located in the form feed path downstream of a supply hopper to discontinue feeding of forms when a form has been delivered from the hopper to the conveyor and engages a feeler on the stop switch.

The label feed apparatus at the labeling station includes a draw roller for withdrawing a carrier ribbon or lable web containing spaced pressure sensitive labels around the corner of a peel plate to strip the labels from the carrier web as the web traverses the small radius corner of the peel plate and apply the severed labels to the form. Two sensors are associated with the label feed mechanism. A mechanical sensor is located in the form feed path and actuates the label feed roller when engaged by a form on the labeling table or outfeed conveyor. Label feed is interrupted by a light sensor associated with the peel plate when it senses a gap on the web between two labels. The label web is stopped so that the next label to be applied is partially peeled from the web.

The label feed bin and the light sensor and light source are shiftable laterally on guide rods to adjust the position of the label for the particular forms being labeled.

Further objects, advantages and features of the invention will become apparent from the following disclosure.

DESCRIPTION OF PREFERRED EMBODIMENT

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figure 1:
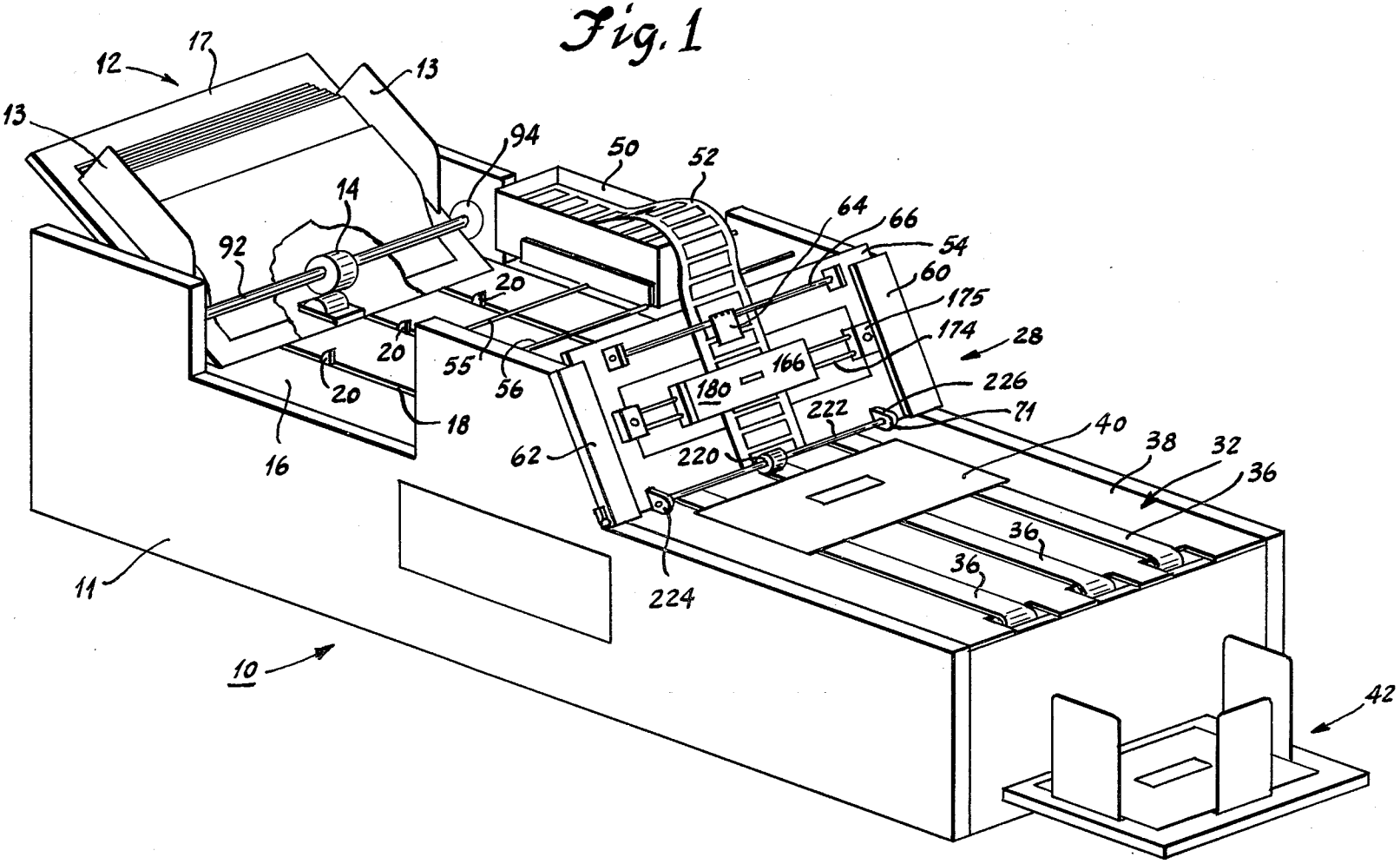
FIG. 1 is a perspective view of labeling apparatus in accordance with the invention.
Figure 2:
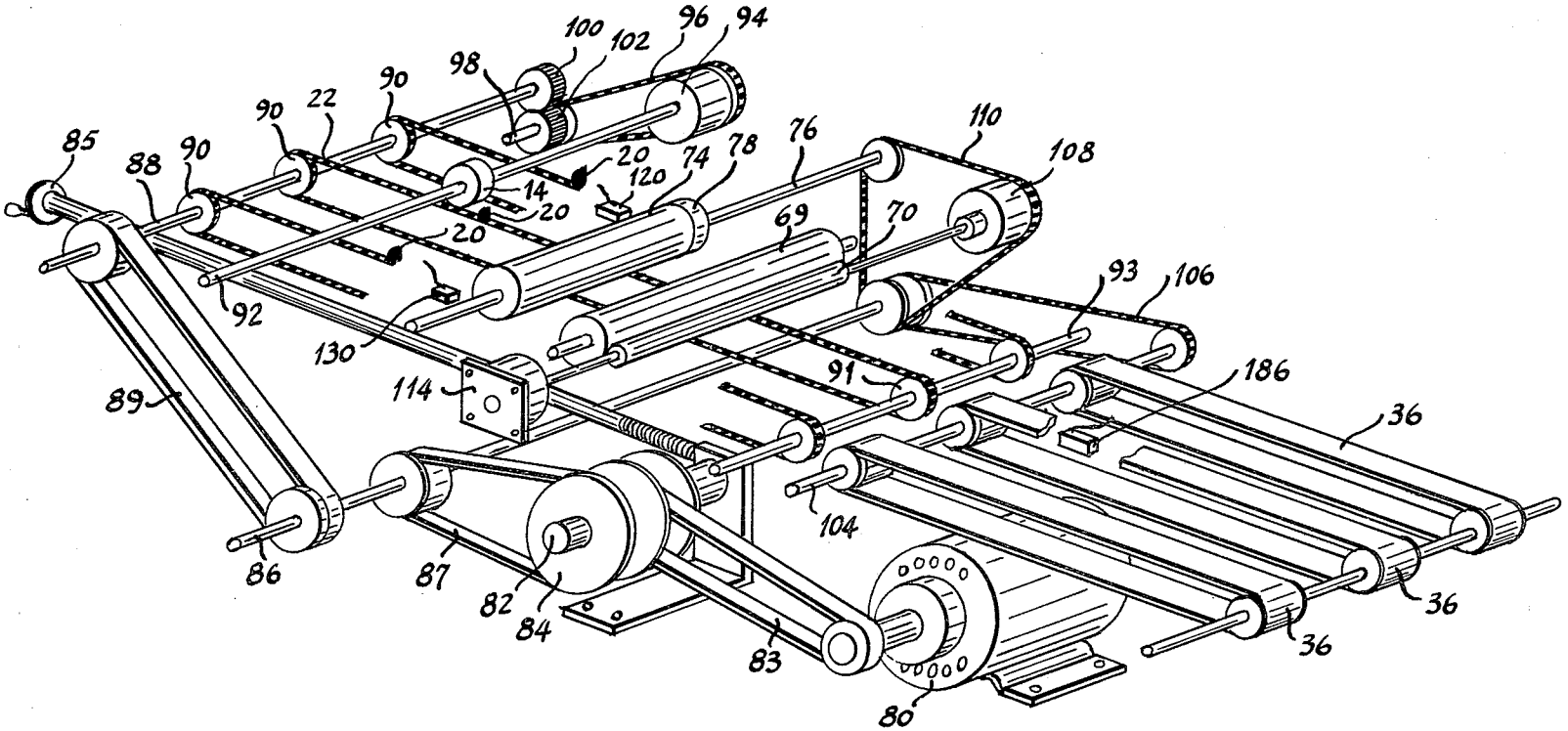
FIG. 2 is a perspective view of the drive mechanism for the infeed and outfeed conveyors and the form feed and label feed rolls.
Figure 3:
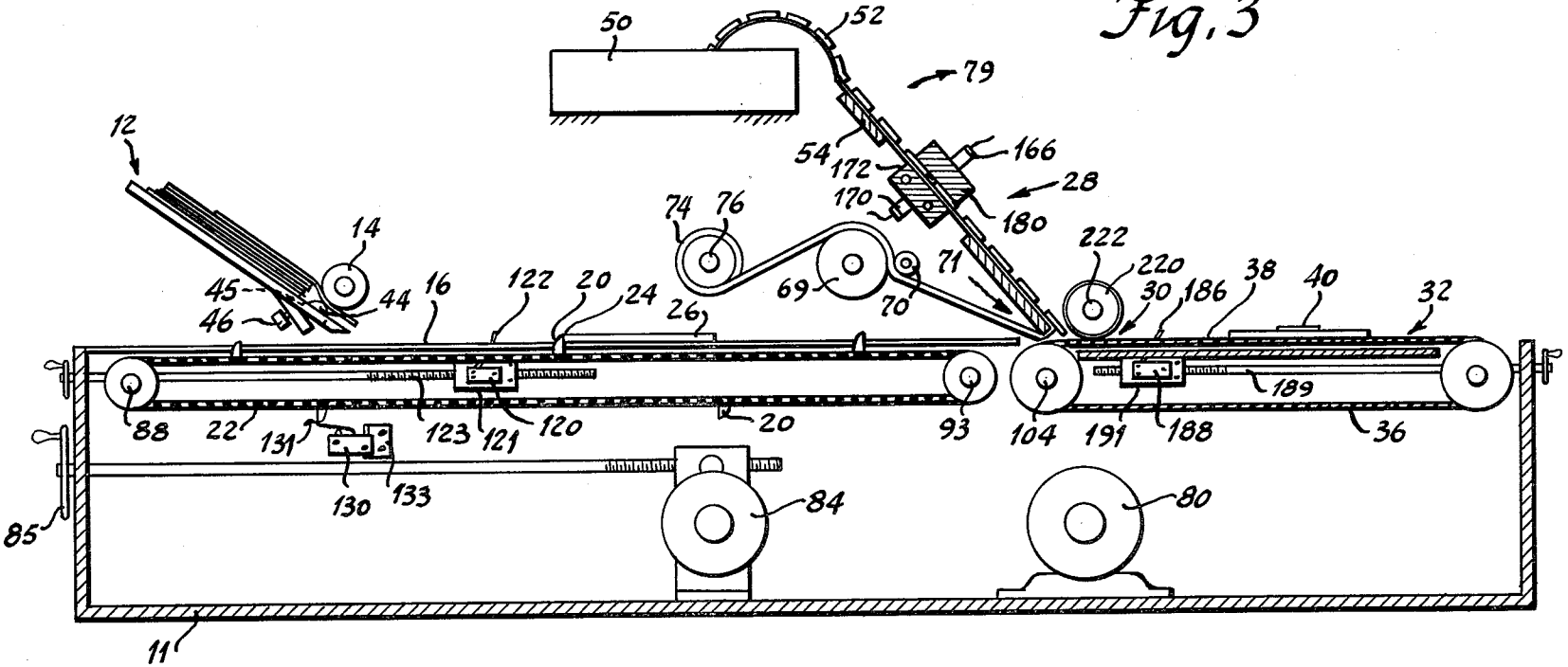
FIG. 3 is a fragmentary side elevational view in partial section of the apparatus shown in FIGS. 1 and 2.

As best shown in FIGS. 1 and 3, the labeling machine 10 includes a frame 11 and hopper 12 which contains a supply of forms (articles to be labeled) which are sequentially delivered by a form feed roller 14 to an infeed conveyor bed or skid plate 16. The infeed conveyor bed 16 is provided with three parallel and longitudinally extending slots 18. Lugs 20 can be adjustably fixed to each of three conveying chains 22 (FIG. 2) extend through the slots to engae and transport the forms. The lugs 20 engage the trailing edge 24 of forms 26 and align and convey the forms in proper alignment to the labeling station 28 located at the gap 30 between the forward end of the infeed conveyor bed 16 and the rear end of the labeling table and outfeed conveyor 32. As best shown in FIGS. 1 and 2, the outfeed conveyor comprises three endless belts 36 with upper runs supported on the surface 38 of the labeling table. The labeled forms 40 are discharged into a collection basket 42 (FIG.1) by the belts 36.

ARTICLE FEED APPARATUS

Referring more specifically to the apparatus disclosed herein, the hopper 12 includes adjustable side plates 13 (FIG. 1) which are adjusted for various size forms and which guide the side edges of the forms to be labeled to insure that the forms are properly oriented when deposited on the infeed conveyor bed 16. A rubber shoe 44 located beneath the feed roller 14 and the forms positions the form relative to the roller to insure proper feeding control of the form with the roller 14. The rubber shoe 44 extends through a slot 45 in the hopper plate 17 and is provided with adjustment screw 46 to vary the spacing of the shoe 44 from the feed roller 14 to accommodate forms of various thicknesses.

The form is deposited on the infeed conveyor bed 16 in advance of the lugs 20 arriving beneath the feed roller 14. Thus, the form is on the bed 16 momentarily before the lugs 20 engage the trailing end of the form and commence movement of the form to the labeling station.

LABELING STATION

The labeling apparatus 28 includes a supply bin 50 which contains a supply of labels which, as disclosed, is in the form of a label carrier web 52 which is accordian folded in the bin 50. Means are provided for supporting the supply bin 50 and affording lateral adjustment of the supply bin and thus, the label web 52 to enable proper positioning of the label on the particular forms being labeled. As disclosed herein (FIG. 1) the means comprises two spaced rods 55, 56 supported by the frame 11. The supply bin 50 is slidingly associated with the rods to afford the desired lateral adjustment.

The web 52 is trained around a peel plate 54 which is inclined to extend downwardly and forwardly in the direction of form movement. The peel plate 54 is supported by channel members 60 and 62 connected to the frame. The label web 52 is urged against the peel plate by a spring steel pressure plate 64 on a carrier rod 66. The pressure plate 64 is adjustable laterally on the rod 66 so that it can be located opposite the label web 52.

The label web is drawn around the corner of the lower end 71 of the peel plate by a knurled draw roll 70 which cooperates with a rubber back-up or pressure idler roll 69. A take-up roll 74 is rotatably mounted on a continuously driven shaft 76. A slip clutch 78 on shaft 76 (FIG. 2) allows the spool to be rotated when slack is present.

To facilitate threading of the label web, the peel plate 54 can be tilted forwardly in the direction of arrow 79. In this regard the channel members 60 and 62 can be hinged to the frame and pivotable forwardly to allow forward movement of the peel plate 54.

DRIVE MECHANISM

To afford synchronous adjustment of the labeling speed, the infeed conveyor, outfeed conveyor, form feed roll and label draw roller, these components are all driven by a common output shaft 86 by motor 80 through a variable drive. The output shaft of motor 80 is drivingly connected by pulleys and a belt 83 to an idler shaft 82 which is provided with a variable diameter pulley 84. The diameter of pulley 84 is controlled by manual crank 85 (FIG. 3). The variable diameter pulley 84 is connected to the common output shaft 86 by a belt 87. The output shaft 86 is drivingly connected to a shaft 88 by a belt 89. The shaft 88 contains three sprockets 90 for driving the chains 22 which convey the form to the labeling station. The forward ends of chains 22 are arranged around the sprockets 91 on an idler shaft 93. The form feed roller 14 is fixed to a shaft 92. An electric clutch 94 operates the shaft 92 by circuits hereinafter described. The clutch 94 is driven by a chain 96. The shaft 98 is driven by gears 100, 102.

The output conveyor belts 36 are driven by a shaft 104 which is connected to the output shaft 86 by a chain 106. The label web draw roller 70 is driven by a clutch 108 which is connected to the output shaft 86 by a chain 110. The chain 110 also drives the take-up roller 74. The roller 70 and label feed are stopped by a brake 114 as subsequently described.

FORM FEED CIRCUIT

Figure 4:
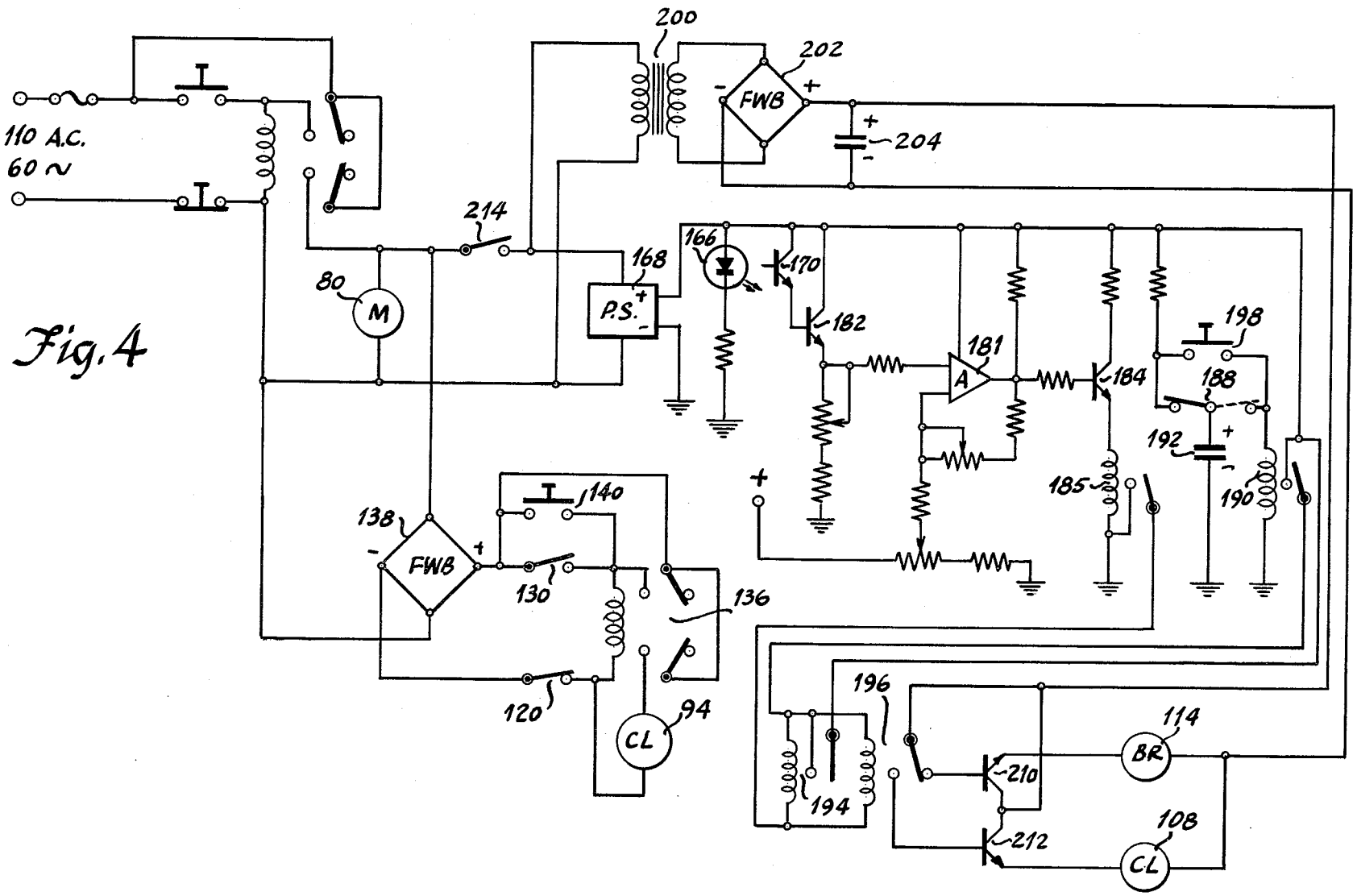
FIG. 4 is a schematic diagram of the electrical circuit for the labeling apparatus shown in FIG. 1.

In accordance with the invention, a circuit is provided for controlling the form feed and label feed. As shown in FIG. 4, the circuit components for controlling form feed include a feed stop switch 120 which has a switch arm or a feeler 122. The switch 120 (FIG. 3) is mounted beneath the infeed conveyor bed and the feeler projects through a slot 18 in the bed to engage the leading edge of a form 26. The stop switch 120 is longitudinally adjustable to accommodate various size forms. A ball nut 121 fixed to a switch bracket, and a threaded crank rod 123 can be employed for adjustment of the position of switch 120.

The form feed circuit also includes a start switch 130 supported on the frame in a position such that the feeler 131 is engaged by the lugs 20 on one of the chains 22. The switch 130 can be supported on a bracket 133. Direct current for a relay 136 is supplied by a rectifier 138. A push-button 140 enables manual control of the form feed cycle when setting up the labeling apparatus for a run with a particular size form.

In operation of the form feed cycle, when the switch 130 (FIG. 3) is actuated by a lug 20 on one of the chains, the relay 136 is energized which in turn energizes the clutch 94 to cause rotation of the form feed roller 14. The form feed roller 14 continues to rotate and cause movement of a form until the leading edge of the form engages the feeler 122 on switch 120 which opens the switch 120 and de-energizes the clutch. The clutch 94 will again be energized when the next lug 20 (FIG. 3) engages the feeler on switch 130 at this point in time for form 26 will have released the feeler on switch 120 so the clutch 94 can be energized. The cycle will thus, continue.

LABEL FEED CIRCUIT

The label feed circuit includes a light emitting diode or other light source 166, a power supply 168 for the diode 166 and a light sensor or light receiver 170 which in the disclosed embodiment is a phototransistor. As best shown in FIGS. 1 and 3, the phototransistor 170 is supported on a plate 172 which is laterally adjustable on guide rods 174 for proper positioning with respect to the label web. The plate mounting blocks 175 can also be adjusted on the peel plate to change the height of the sensor. The light source 166 is also supported or carrier on a plate 180 which is laterally adjustable on two guide rods 174. The light sensor 170 stops or interrupts label feed as presently described.

The label feed circuit also includes a differential amplifier 181 which is coupled to the emitter of a transistor 182 which is coupled to the sensor 170. When a label is in registry between the light source 166 and the light sensor 170, the sensor is in the dark mode and receives less light than when a gap in the labels is in registry (light mode). When the sensor 170 is in the dark mode, the differential amplifer 181 provides an output signal to the base of a transistor 184 which energizes relay 185 and maintains it in a closed position. When a form passes under the labeling station and the leading edge of the form engages the feeler 186 of a switch 188, the relay 190 is momentarily energized through energy stored in a capacitor 192. When relay 190 is momentarily energized, it in turn energizes and latches a relay 194 which energizes a relay 196 which is parallel with relay 194. When relay 196 is energized it causes the brake 114 to be de-energized to release the label drive roller 70 which is driven as clutch 108 is simultaneously energized. The label web is thus, caused to move around the peel plate and deliver a label to the form. When the light sensor 170 senses a gap between labels due to a larger quantity of light being received through the relatively transparent gap in the web, the increased energy results in no output from the differential amplifier 181 which in effect, cuts off the output signal to the base of the transistor 184 thereby de-energizing the relay 185 which opens the circuit to relays 194 and 196. Upon de-energization of relay 196, the clutch 108 is de-energized and brake 114 energized to stop label feed. The label feed is desirably stopped with a label partially peeled as shown in FIG. 3. The longitudinal position of the switch 188 can be adjusted with a threaded crank rod 189 threaded into a ball nut 191 fixed to the switch 188. Channel members not shown can be employed to confine movement of the ball nut.

A push-button 198 can be provided for manual sequencing of the label feed cycle during setup. Power for the clutch and brake is provided by a transformer 200 and rectifier 202. The capacitor 204 filters the DC output which is used to run the clutch and brake. The transistors 210 and 212 function as switches when driven into saturation when relay 196 is energized. The switch 214 energizes the label feed circuit.

A freely rotating roller 220 (FIG. 1) is provided to press the labels onto the forms and insure engagement of the label with the form. The roller 220 can be supported on a shaft 222 to afford lateral adjustment corresponding to label position. The shaft is supported for vertical and horizontal adjustment by brackets 224, 226 adjustably connected to the frame. The adjustment afforded for the shaft 222 is desirable for appropriate positioning of the roller so it will press the form against one of the belts 36 so that the belts 36 which move faster than the chains 22 will quickly accelerate the forms from the chains so that the forms will be free of the lugs 20 when they travel around the sprockets 91. The switches 120 and 188 can be photo-responsive switches rather than mechanical switches.

I claim:

1. Labeling apparatus for dispensing labels from a label carrier web containing a plurality of spaced labels comprising an article feed conveyor, an outfeed conveyor, label feed means comprising a peel plate extending downwardly and forwardly in the direction of article feed, feed means for drawing a label carrier web along and around said peel plate, a light source located on one side of the web, light sensing means having a first mode when a label is in registry and a second mode when a gap between labels is in registry, second sensing means associated with said outfeed conveyor to sense the presence of an article to be labeled, and circuit means coupled to said first and second sensing means whereby actuation of said second sensing means by an article carried on said outfeed conveyor will cause energization of said label feed means to cause movement of the label web and wherein said first sensor will de-energize said feed means when said light sensing means is in said second mode and a gap between said labels is sensed by said first sensing means to stop movement of the label carrier web whenever a gap between labels is sensed and wherein said light sensing means is a photo transistor, and said circuit means includes a differential amplifier coupled to said phototransistor to provide an output signal when a label is in registry with said phototransistor and no output when a gap between labels is in registry and said circuit including an output switch circuit coupled to said differential amplifier and wherein, said label feed means includes a brake and clutch and said output switch circuit energizes said brake and de-energizes said clutch to stop label feed when said first sensor senses a gap between labels and said brake being de-energized and said clutch being energized when an article is sensed by said second sensing means to cause label feed.

2. Labeling apparatus comprising a frame, an infeed conveyor, an article feed hopper associated with said infeed conveyor, including a feed roller, a drive train for said feed roller including a clutch, said infeed conveyor including conveying chains with laterally aligned lugs adapted to engage the trailing edge of the article to be labeled and convey the article to a labeling station, a first switch supported on said frame and associated with said infeed conveyor and in the path of movement of articles on said conveyor, a second switch supported on said frame and engageable by said lugs whereby movement of said chains starts an article feed cycle causing actuation of said second switch and energization of said clutch and rotation of said feed roller to cause delivery of an article to be labeled to the infeed conveyor and wherein said first switch is subsequently actuated by said article to de-energize said clutch and stop said article feed roller.

3. Apparatus in accordance with claim 2 including means for adjustably supporting said switches on said frame to vary the longitudinal positions of said switches to provide feed cycles of different intervals for different size forms.

4. Labeling Apparatus in accordance with claim 2 including an outfeed conveyor, means for moving said outfeed conveyor faster than said infeed conveyor, a peel plate and means for conveying a label web about said peel plate and roller means located adjacent said peel plate for pressing a dispensed label against the article and for pressing the articles against the outfeed conveyor to accelerate the article to afford clearance with said lugs.

* * * * *